United States Patent [19]

Wilkinson

[11] Patent Number: 4,833,811

[45] Date of Patent: May 30, 1989

[54] SAFETY FOR PISTOLS

[76] Inventor: Earl Wilkinson, Rt. 9, Box 2815, Henderson, Tex. 75652

[21] Appl. No.: 216,220

[22] Filed: Jul. 7, 1988

[51] Int. Cl.[4] ..... F41C 17/08

[52] U.S. Cl. ..... 42/70.08; 42/66; 42/70.11

[58] Field of Search ..... 42/66, 70.01, 70.08, 42/, 70.11; 89/148

[56] References Cited

U.S. PATENT DOCUMENTS

| | | | |
|---|---|---|---|
| 875,469 | 12/1907 | Tambour . | |
| 891,748 | 6/1908 | Tambour . | |
| 905,020 | 11/1908 | Tambour . | |
| 1,313,073 | 8/1919 | Donadio . | |
| 2,945,316 | 7/1960 | Mulno . | |
| 3,624,947 | 12/1971 | Worrall . | |
| 3,838,533 | 10/1974 | Ruger . | |
| 4,024,664 | 5/1977 | Murabito . | |
| 4,067,132 | 1/1978 | Smith . | |
| 4,136,475 | 1/1979 | Centille . | |
| 4,261,127 | 4/1981 | Karkkainen . | |
| 4,467,545 | 8/1984 | Shaw . | |
| 4,672,763 | 6/1987 | Cunningham | 42/70.11 |

FOREIGN PATENT DOCUMENTS 200967 12/1958 Fed. Rep. of Germany ... 412/70.08

*Primary Examiner*—Deborah L. Kyle
*Assistant Examiner*—Richard W. Wendtland
*Attorney, Agent, or Firm*—John M. Harrison

[57] ABSTRACT

A safety for hammer-equipped pistols, which includes a lock pin slidably mounted in the handle of a pistol, a companion lock pin spring biasing the lock pin inwardly of the handle toward the hammer, a locking rod slidably mounted in the handle in angular relationship with respect to the lock pin, the upper end of which locking rod is adapted to normally engage a seat provided in the lock pin and a release pin normally located in a release pin seat provided in the base of the handle, for engaging the opposite, or lower end of the locking rod and preventing relative movement between the locking rod and the lock pin. In a preferred embodiment, one end of a release pin cable is attached to the release pin and the opposite end of the cable is secured to the pistol holder, wherein seizure and extension of the pistol beyond the length of the cable pulls the release pin from the release pin seat and allows the locking rod to slide downwardly inside the pistol handle and facilitate forward projection of the lock pin responsive of the lock pin spring and locking of the hammer to prevent firing of the pistol.

16 Claims, 1 Drawing Sheet

SAFETY FOR PISTOLS

BACKGROUND OF THE INVENTION

1. Field of the Invention

The invention relates to safety mechanisms for handguns and more particularly, to a safety device for hammer-equipped pistols and revolvers, including service revolvers used by law enforcement officers. A primary component of the safety device of this invention is a lock pin slidably mounted in the upper portion of the pistol handle or grip and biased toward the hammer by means of a lock pin spring. A locking rod is also slidably mounted in the handle in angular relationship with respect to the lock pin, with the upper end of the locking rod engaging a seat located in the lock pin, for retaining the lock pin inwardly of the handle against the bias of the lock pin spring. A release pin is fitted into a bore located in the base of the pistol handle for normally engaging the lower end of the locking rod and maintaining the upper end of the locking rod in contact with the lock pin. The pistol can be fired so long as the release pin is seated in the basde of the handle. However, if the release pin is pulled from the handle, the locking rod is allowed to slide downwardly by operation of gra0ity from engagement with the lock pin and the lock pin is then forced inwardly beneath the hammer in the path of the hammer flange by tension in the lock pin spring, to lock the hammer and prevent firing of the pistol. In a preferred embodiment, the release pin is secured to a holster for containing the weapon by means of a release pin cable, in order to facilitate retraction of the pin from the handle of the gun if the gun is seized by an assailant and pulled from the grasp of a law enforcement officer, thereby disabling the weapon from firing.

A hazard which results in the death of manyl law enforcement officers annually is that of seizing the officer's handgun, either from the holster or from the hand of the officer himself. These seizures sometimes occur during struggles with an assailant during the commission of a crime and frequently result in the death or wounding of the police officer by his own weapon. Since the handgun must always be carried in a readily accessible position in a holster worn by a police officer, the weapon is accessible not only to the officer himself in the course of enforcing the law, but also to others who may be in close proximity to the officer. Accordingly, the weapon can be grasped grasped and pulled from the holster or from the officer's hand by stealth or under conditions of struggle.

2. Field of the Invention

Various types of safety and lock mechanisms for firearms and handguns in particular, are known to those skilled in the art. A typical safety lock for firearms is detailed in U.S. Pat. No. 2,945,316, date July 19,1960, to L. F. Mulno. The safety lock includes a spring-loaded guide stem located within the firearm frame and acting on the hammer when in cocked position, to urge the hammer into firing position. A trigger is carried by the frame for releasibly holding the hammer in cocked configuration and a releasable locking mechanism is also included in the frame, which locking mechanism includes a threaded locking member having a part movable toward and away from the lower end of the stem, such that the locking member is engageable with the stem to prevent it from moving to the cocked position. The threaded locking member is movable within the frame for moving the part to and from the locking position and a key is designed to selectively engage and disengage the outer end portion of the threaded member for turning it to and from the locking position. U.S. Pat. No. 875,469, dated Dec. 31,1907, to J. Tambour, details an "Automatic Safety Appliance for Locking the Hammer and the Sear of Small Arms". This patent details a locking lever adapted to engage the sear and hammer disk when the hammer disk is in either a cocked or uncocked position and a rotating pin for locking the lever into a selected configuration. A "Safety Locking Device For Small Arms" is detailed in U.S. Pat. No. 891,148, dated June 23,1908, also to J. Tambour. The device includes a rotating member mounted at the base of the handle with a locking linkage connecting the rotating member to the hammer, in order to selectively lock the hammer and prevent the weapon from firing. U.S. Pat. No 905,020, dated Nov. 24,1908, also to J. Tambour, further details a "Safety Lock for Revolvers, Pistols or the Like". The device includes a safety lever, a locking lever connecting to the safety lever and engaged by a main spring and an exteriorly-projecting and operative device for manipulating the locking lever into and out o fa locking position in which it locks the safety lever. U.S. Pat. No. 4,024,664, dated May 24,1977, to Frank Murabito, details a "Safety for Rifle". The Safety device includes a rod connected to a lever which cam be inserted through a bore on the back side of the rifle hammer when the hammer is extended slightly pass the fully cocked position. The rod is adapted to engage the hammer and prevent the hammer from moving regardless of the motion of the trigger. U.S. Pat. No. 4,135,320, dated Jan. 23,1979, to Joseph E. Smith, details a "Magnetically Actuable Safety Apparatus". The apparatus typically includes a magnetically -actuable member slidably mounted in a housing and a magnetic biasing means juxtaposed the magnetically actuable member, for maintaining the member in blocking relationship with the part. A magnetic means is provided from without the device for overcoming the attraction or repulsion of the magnetic biasing means, whereby the part is free to move. A similar device is detailed in U.S. Pat. No. 4,154,014, dated May 15,1979, also to Joseph E. Smith. U.S. Pat. No. 4,467,545, dated Aug. 28,1984, to Fredric A Shaw, Jr., details a "Personalized Safety Method and Apparatus for a Hand-Held Weapon". The patent details a hand-held weapon which is fitted with a safety device responsive to the palm or fingerprint of one or more individuals. A safety device is activated by heat sensed when the device is held in the hand. Unless the palm or fingerprint ot the person holding the device matches a pre-stored pattern, a blocking safety mechanism, normally preventing operation of the weapon, is maintained in its "blocking state" the weapon will not fire. A safety device for preventing the unauthorized firing of a weapon is detailed in U.S. Pat. No. 4,067,132, dated Jan. 10,1978, to Joseph E. Smith. The patent details a trigger safety device for trigger-actuated devices, which device includes a picotally-mounted, magnetically-responsive bar positioned on the inside of the handle or on the rear of the trigger. When the bar is oriented centrally, sufficient movement of the trigger is inhibited to prevent actuation. The bar may be mounted in a non-magnetizable casing and the user of the device displaces the bar from its central orientation by operation of a magnetic ring and allows sufficient movement of the trigger for actuation. U.S. Pat. No. 4,672,763, dated June 16, 1987, to Jerry M. Cunningham, details a "Safety Device for Preventing the Unauthorized Firing of a Weapon by Releasing the Hammer Spring". The device includes a hammer, a handle and a leaf spring located inside the handle. The leaf spring places tension on the hammer when the weapon is enabled and is held by a stop member is movable. When the stop member is moced to a lower position, the spring is released and the weapon is disabled. The stop member is moved by a strap and a ring connected to the stop member and the handle must be disassembled in order to return the spring and the stop member to the enable condition.

It is an object of this invention is to provide a new and improved safety for pistols, which safety is characterized by a release pin slidably mounted in the base of a handgun handle or grip for retaining a lock pin and locking rod combination in pistol-firing configuration, such that release of the release of the release pin facilitates slidable adjustment of the locking rod and the lock pin in the hand gun grip to prevent the weapon from firing.

Another object of this invention to provide an new and improved safety for hammer-operated handguns and revolvers in particular, which safety is characterized by a lock pin slidably mounted in the top portion of the handle of the weapon, a locking rod also slidably mounted in the handle substantially transversed to, or in angular relationship with respect to the lock pin, with one end of the locking rod engaging a seat located in the lock pin and further including a release pin inserted in the base of the handle, for engaging the opposite end of the locking rod and retaining the locking rod in engagment with the lock pin to prevent the lock from locking the hammer.

Yet another object of this invention is to provide a new and improved safety for handguns, and revolvers in particular, which safety is characterized by spring-loaded lock pin slidably mounted in a bore provided in the frame of the handgun at the top of the handle or grip, and elongated locking rod having an upper end normally seated in a receptacle or seat located in the lock pin and the opposite, or lower end of the locking rod engaging a release pin slidably mounted in the base of the grip and further including a cable connecting the release pin to a holster designed to carry the weapon. Removal of the release pin responsive to tension in the cable when the weapon is seized and removed from the holster allows the locking rod to slide downwardly by operation of gravity from engagement with the lock pin and spring bias causes the lock pin to then engage a hammer flange projecting from the hammer and thereby prevent firing of the weapon.

SUMMARY OF THE INVENTION

These and other objects of the invention are provided in a safety for pistols, handguns and revolvers in particular, which safety includes a spring-biased lock pin located in the grip of the weapon in alignmrnt with the path of pivot of the hammer flange in a hammer, alocking rod slidably provided in the handle, with the upper end of the locking rod normally engaging a seat located in the lock pin and the opposite end of the locking rod normally engaging a removable release pin to maintain the gun in firing configuration. Further included in a preferred embodiment is a coiled release pin cable connecting the release pin to a holster for carrying the weapon. Removal of the release pin from the handle of the weapon by tension applied to the release pin cable responsive to unauthorized removal of the weapon from the holster causes the locking rod to disengage the lock pin and facilitate engagement of the lock pin with the hammer flange when the trigger is pulled, thereby preventing the weapon from firing.

BRIEF DESCRIPTION OF THE DRAWING

The invention will be better understood by reference to the accompanying drawing, wherein.

DESCRIPTION OF THE PREFERRED EMBODIMENTS

Figure 1:
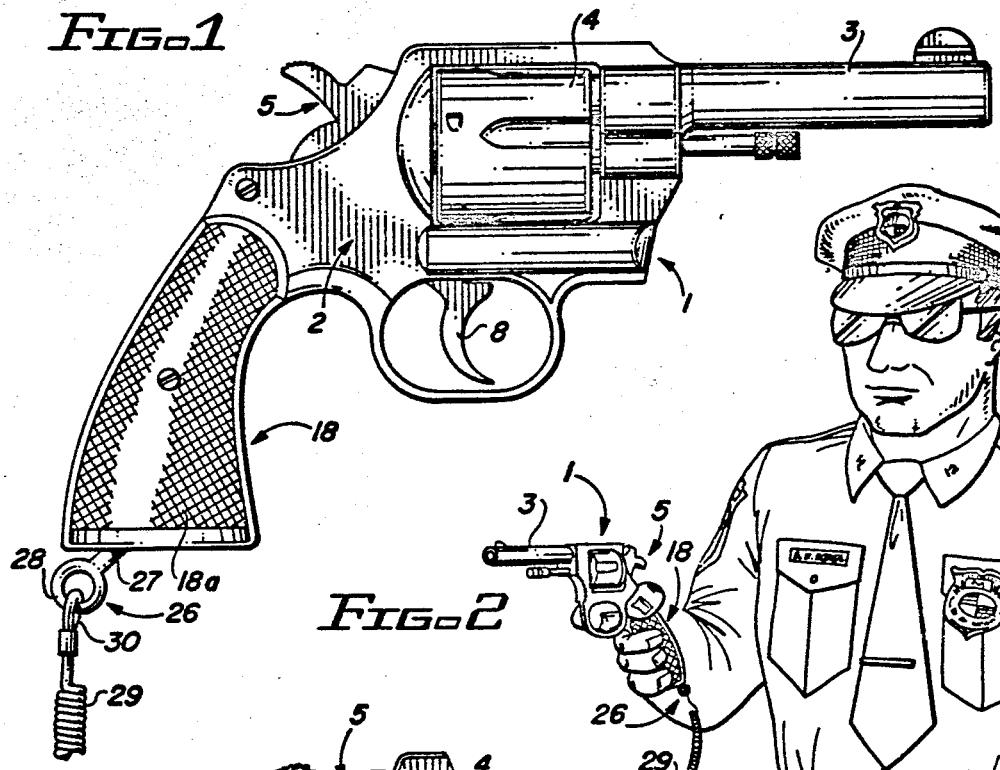
FIG. 1 is a side view of a typical revolver handgun or pistol with the release pin and release pin cable elements of the safety of this invention provided therein.
Figure 2:
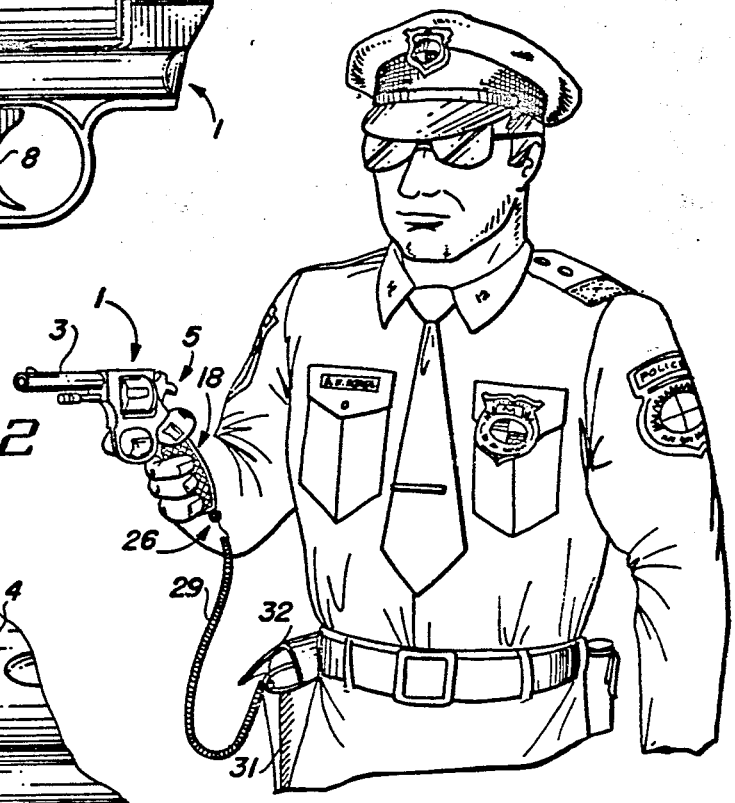
FIG. 2 is perspective view of the revolver illustrated in FIG. 1 held by a law enforcement officer and illustrating additional features of the safety.
Figure 3:
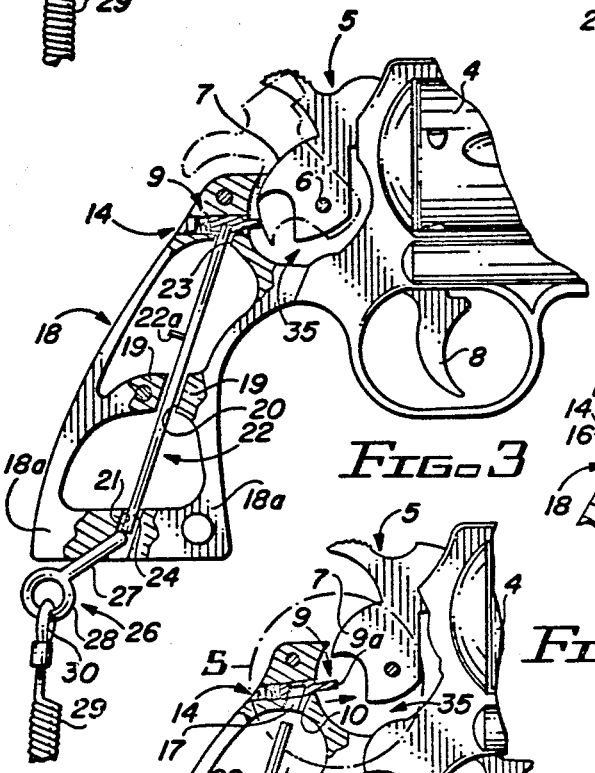
FIG. 3 is a side view, partially in section, of the handle and rear frame portion of the revolver illustrated in FIG 1, with the release pin inserted in the handle as illustrated in FIG. 1 to maintain companion locking rod and lock pin elements of the revolver in firing configuration.
Figure 4:
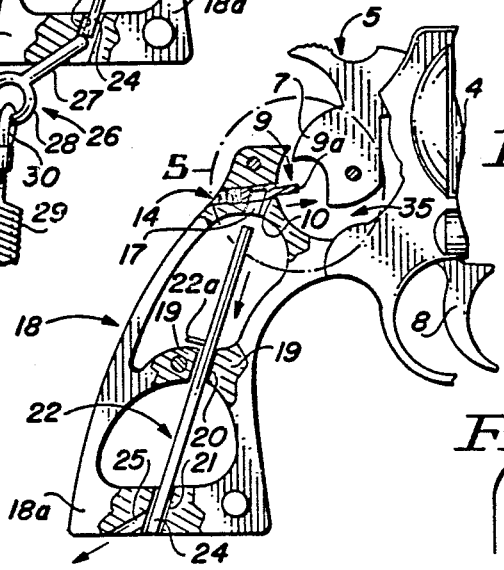
FIG. 4 is a side view, partially in section, of the handle and rear frame portion of the revolver illustrated in FIG. 3, with the release pin removed from the handle and the lock pin element positioned in functional position for engagement with the hammer flange of the revolver hammer to prevent firing of the weapon.

Referring initially to FIGS. 1–4 of the drawing, a conventional service revolver or pistol is generally illustrated by reference numeral 1 and includes a frame 2, a barrel 3 mounted in the frame 2 and a cylinder 4 rotatably seated in the frame 2 in conventional relationship. A hammer 5 is also mounted in the frame 2 and is pivotally activated by operation of a trigger 8 in conventional fashion. The hammer 5 is further characterized by a hammer pivot pin 6, which extends into the frame 2 and a downwardly-extending hammer flange 7, as illustrated in FIG. 3 of the drawing. A handle 18 is mounted on the frame 2 in conventional fashion and receives a release pin 26 at the bottom end or base thereof, as one element of the safety of this invention. The release pin 26 is further characterized by an elongated release pin shaft 27, which extends into a release pin bore or seat 25, provided in the handle base **18*a* of the handle 18, as illustrated in FIG. 4. In a most preferred embodiment of the invention, a release pin ring 28 is provided in the release pin 26 and one end of a coiled release pin cable 29 is fitted to the release pin ring 28, while the opposite end of the release pin cable 29 is attached to the holster 31 by means of a holster ring 32**, as illustrated in FIG. 2.

Figure 5:
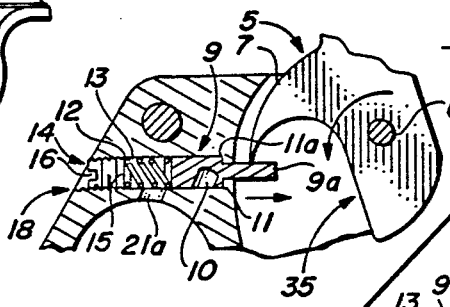
FIG. 5 is an anlarged sectional view of the upper handle and rear frame portion of the revolver illustrated in FIG. 4, more particularly illustrating engagement of the hammer flange with the lock pin element of the safety to prevent firing of the weapon.

Referring now to FIGS. 3–6 of the drawing, a lock pin 9 is slidably seated in a lock pin bore 12, which is drilled or otherwise provided in the top portion of the handle 18 and the lock pin 9 is provided with a lock pin shoulder 11, for engaging a shoulder seat 11*a*, provided in the lock pin bore 12, when the lock pin end 9*a* is extended into the hammer chamber 35 and into the path of pivot of the hammer flange 7, as illustrated in FIG. 5. A locking rod seat 10 is also drilled or otherwise provided in the bottom of the lock pin 9 opposite the lock pin shoulder 11, in order to receive the upper rod end 23 of a locking rod 22, which is slidably disposed in a rod guide slot 20, provided in a locking rod guide 19 and in a companion lower rod seat 21, both located inside the handle 18 and constituting structural elements of the handle 18. The opposite or lower rod end 24 of the locking rod 22 extends into the locking rod seat 21 provided in the handle base 18*a* of the handle 18 and the locking rod seat 21 is further provided in commuication with a release pin seat 25, which receives the release pin shaft 27 of the release pin 26, as illustrated in FIGS. 3 and 4. Referring again to FIG. 5 of the drawing, in a most preferred embodiment of the invention the projecting lock pin end 9*a* of the lock pin 9 is urged or baised in the direction of the arrow into the hammer chamber 35 and into the path of pivot of the hammer flange 7 by means of a lock pin spring 13 located in the lock pin bore 12, the tendion of which lock pin spring 13 is adjusted by means of the adjusting screw 14. The adjusting screw 14 is further provided with adjusting screw threads 15, which mate with corresponding threads (not illustrated) located in the lock pin bore 12 of the handle 18 and an adjusting screw slot 16, provided in the exposed end of the adjusting screw 14, facilitates adjustment of the adjusting screw 14 in the lock pin bore 12 to adjust the bias in the lock pin spring 13. Accordingly, it will be appreciated from a consideration of FIGS. 3–5, that when the release pin shaft 27 of the release pin 26 is removed from the release pin seat 25, the locking rod 22 drops by operation of gravity in the direction of the arrow illustrated in FIG. 4 from engagement with the rod seat 10 and the lock pin 9. The locking rod 22 moves downwardly until the rod stay 22*a* , which projects from the locking rod 22, engages the locking rod guide 19, to prevent the locking rod 22 from exiting the handle 18 through the lower rod seat 21. Movement of the upper rod end 23 from the locking rod seat 10 and the rod access slot 17 facilitates movement of the lock pin 9 in the direction of the arrow illustrated in FIG. 4 and the lock pin end 9*a* into the hammer chamber 35, as further illustrated in FIG. 5. The lock pin shoulder 11 then engages the shoulder seat 11*a* to prevent further extension of the lock pin end 9*a* into the hammer chamber 35 and the bias in the lock pin spring 13 serves to retain the lock pin end 9*a* in the hammer chamber 35, as illustrated. Accordingly, when the trigger 8 is pulled as illustrated in FIG. 2, the hammer 5 pivots rearwardly on the hammer pivot pin 6 until the hammer flange 7 contacts the lock pin end 9*a*, which contact prevents further pivoting of the hammer 5 and firing of the revolver.

Figure 6:
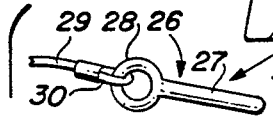
FIG. 6 is a side view, partially in section, of the handle and rear frame portion of the pistol illustrated in FIG. 4, more particularly illustrating an alternative biased mounting of the locking rod element of the safety.
Figure 6:
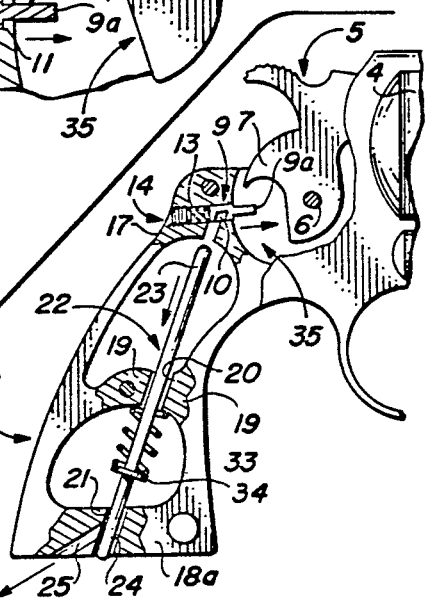

Referring now to FIG. 6 of the drawing, in an alternative preferred embodiment of the invention a locking rod spring 33 is mounted on the locking rod 22 intermediate the ends thereof and beneath the locking rod guide 19, by means of a locking rod washer 34, which is welded or otherwise attached to the locking rod 22. The locking rod spring 33 seats against the locking rod guide 19, in order to normally bias the lower rod end 24 of the locking rod 22 against the release pin shaft 27 of the release pin 26. Accordingly, when the release pin 26 is removed from the release pin seat 25 tension in the locking rod spring 33 forces the locking rod 22 downwardly in the direction of the arrow and causes the upper end 23 of the locking rod 22 to exit the locking rod seat 10 in the lock pin 9 and allow the lock pin end 9*a* to project into the hammer chamber 35, as heretofore described.

Referring again to FIGS. 2 and 3 of the drawing, in another preferred embodiment of the invention the release pin 26 is provided with a release pin ring 28 for receiving the cable loop 30 of the release pin cable 29, in order to secure one end of the release pin cable 29 to the release pin 26. The opposite end of the release pin cable 29 is secured to the holster ring 32 of the holster 31, such that the release pin 26 will be pulled from the release pin seat 25 if the pistol 1 is seized from the officer. In this event, the locking rod 22 slides downwardly in the handle 18 and the lock pin 9 is free to move forward under the bias of the lock pin spring 13, to project the lock pin and 9*a* into the hammer chamber 35 and prevent the hammer 5 from firing the pistol 1, as heretofore described.

It will be appreciated by those skilled in the art that the safety of this invention is characterized by a positive and fail-safe mechanism for preventing a handgun from firing when a release pin is removed from the base of the firearm handle. Furthermore, the safety can be utilized in any hammer-operated handgun which is provided with sufficient room in the handle to facilitate operating of the lock pin 9, locking rod 22 and the release pin 26. However, the safty is particularly well suited and is adaptable for revolver handguns and weapons because of the readily availabe space located in the interior of the handles 18 of these weapons to mount the lock pin 9, locking rod 22 and the release pin 26.

While the preferred embodiment of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A safety for a handgun having a handle and a pivoting hammer, comprising a lock pin slidably mounted in the handle, said lock pin adapted for selectively engaging the hammer in non-firing configuration; lock pin bias means provided in contact with said lock pin for biasing said lock pin in the path of pivot of the hammer for engagement with the hammer; a locking rod slidably provided in the handle in angular relationship with respect to said lock pin, with the upper end of said locking rod normally engaging said lock pin against the bias means and preventing said lock pin from extending into said path of pivot and contacting the hammer; a locking rod seat provided in said lock pin for receiving said upper end of said locking rod when the pistol is in firing configuration; and a release pin removably inserted in the base of the handle, said release pin provided in engagement with the opposite end of said locking rod for securing said upper end of said locking rod against said lock pin, whereby removal of said release pin from the handle causes said locking rod to disengage said lock pin and said lock pin to engage the hammer, responsive to operation of said pin bias means.

2. The safety of claim 1 wherein said lock pin bias means further comprises a first coil spring and further comprising an adjusting screw threadibly provided in the handle and seated against said coil spring for adjusting the bias in said first coil spring.

3. The safety of claim 1 wherein said lock pin bias means further comprises a first coil spring and further comprising an adjusting screw threasably provided in the handle and seated against sais first coil spring for adjusting the bias in said first coil spring.

4. The safety of claim 1 further comprising a holster worn by the user of the pistol and a release pin cable having one end attached to said release pin and the opposite end secured to said holster, whereby removal of the pistol from said holster to a distance greater than the length of said release pin cable removes said release pin from the handle of the pistol and secures the pistol in non-firing configuration.

5. The safety of claim 4 wherein said lock pin bias means further comprises a first coil spring and further comprising an adjusting screw threadably provided in the handle and seated against said first coil spring for adjusting the bias in said first coil spring.

6. The safety of claim 1 further a lock pin bore provided in the handle for receiving said lock pin in sliding relationship, a shoulder seat provided in said lock pin bore and a shoulder shaped in said lock pin, said shoulder defining an extending lock pin end, whereby said shouler engages said shoulder seat said lock pin end extends into said path of pivot of the hammer when said release pin is removes from the handle.

7. The safety of claim 6 wherein said lock pin bias means further comprises a first coil spring and further comprising an adjusting screw threadibly provided in said lock pin bore, said adjusting scew seated against said first coil spring for adjusting the bias in said first coil spring.

8. The safety of claim 7 further comprising a holster worn by the user of the pistol and a release pin cable having one end attached to said release pin and the opposite end secured to said holster, whereby removal of the pistol from said holster to a distance greater than the lenght of said release pin cable removes said release pin from the handle of the pistol and secures the pistol is non-firing configuration.

9. The safety of claim 1 further comprising locking rod bias means mounted on said locking rod for normally biasing said locking rod against said release pin.

10. The safety of claim 9 wherein said lock pin bias means further comprises a first coil spring and further comprising:

(a) a lock pin bore provided in the handle for receiving said lock pin in sliding relationship, a shoulder seat provided in said lock pin bore and a shoulder shaped in said lock pin, said shoulder defining an extending lock pin end, whereby said shoulder engages said shoulder seat and said bore and extends into the path of pivot of the hammer when said release pin is removed from the handle;

(b) an adjusting screw threadably provided in said lock pin bore and seated against said first coil spring for adjusting the bias in said first coil spring; and (c) a holster worn by the user of the pistol and a release pin cable having one end attached to said release pin and the opposite end secured to said holster, whereby removal of the pistol from the holster to a distance greater than the length of said release pin cable removes said release pin from the handle of the pistol and secures the pistol in non-firing configuration.

11. The safety of claim 10 wherein said locking rod bias means further comprising a second coil spring mounted on said locking rod and engaging the handle for biasing said opposite end of said locking rod against said release pin.

12. A safety for a pistol having a handle and a pivoting hammer provided with a downwardly-extending hammer flange, comprising a lock pin slidably mounted in the handle, said lock pin adapted for selectively engaging said hammer flange in non-firing configuration; as first coil spring provided in contact with said lock pin for biasing said lock pin in the path of pivot of said hammer flange for engagement by said hammer flange; a locking rod slidably provided in the handle in angular relationship with respect to said lock pin, with the upper end of said locking engaging said lock pin against the bias of said first coil spring and normally preventing said lock pin from extending into said path of pivot and contacting said hammer flange; a locking rod seat provided in said lock pin for receiving said upper end of said locking rod when the pistol is in firing configuration; and a release pin removably inserted in the base of the handle, said release pin provided in engagment with the opposite end of said locking rod for securing said upper end of said locking rod against said lock pin, whereby removal of said release pin from the handle causes said locking rod to disengage said lock pin and said lock pin to extend into said path of said hammer flange and engage said hammer flange, responsive to operation of said firsts coil spring.

13. The safety of claim 12 further comprising an adjusting screw threadibly provided in the handle and seated against said coil spring for adjusting the bias in said first coil spring.

14. The safety of claim 13 further comprising a lock pin bore provided in the handle for receiving said adjusting pin in threadable relationship and receiving said lock pin in sliding relationship, a shoulder seat provided in said lock pin bore and a shoulder shaped in said lock pin, said shoulder defining an extending lock pin end, whereby said shoulder engages said shoulder seat and said lock pin end extends into said path of pivot of said hammer flange when said release pin is removes from the handle.

15. The safety of claim 14 further comprising a holster worn by the user of the pistol and a release pin cable having one end attached to said release pin and the opposite end secured to said holster, whereby removal of the pistol from said holster to a distance greater than the length of said release pin cable removes said release pin from the handle of the pistol and secures the pistol in non-firing configuration.

16. A safety for a handgun having a handle and a pivoting hammer provided with a downwardly-extending hammer flange, comprising a lock pin bore provided in the handle and a lock pin slidably mounted in said pin bore, said lock pin adapted for selectively engaging said hammer flange in non-firing configuration; a first coil spring provided in said lock pin bore in contact with said lock pin for biasing lock pin in the path of pivot of said hammer flange for engagement by said hammer flange; internal threads provided in said lock pin bore and an externally threaded adjusting screw adapted to threadably engage said internal said threads and seat against said first coil spring for adjusting the bias in said first coil spring; a locking rod slidably provided in the handle in angular relationship with respect to said lock pin, with the upper end of said locking rod engaging said lock pin against the bias of said first coil spring and normally preventing said lock pin from extending into said path of pivot and contacting said hammer flange; a release pin removably inserted in the base of the handle, said release pin provided in engagement with the opposite end of said locking rod for securing said upper end of said locking rod against said lock pin; and a second coil spring mounted on said locking rod and engaging the handle for biasing said opposite end of said locking rod against said release said release pin and a holster worn by the user of the pistol and a release pin cable having one end attached to said release pin and the opposite end secured to said holster, whereby removal of the pistol from said holster to a distance greater than the length of said release pin cable removes said release pin from the handle of the pistol and secures the pistol in non-firing configuration.

* * * * *